US005209513A

United States Patent [19]

Batelli et al.

[11] Patent Number: 5,209,513

[45] Date of Patent: May 11, 1993

[54] METHOD FOR PREVENTING COUNTERFEITING OF SALES RECEIPTS

[75] Inventors: Orlando C. Batelli, Houston; Michael A. Repp, Cypress, Tex.

[73] Assignee: Wallae Computer Services, Inc., Hillside, Ill.

[21] Appl. No.: 803,567

[22] Filed: Dec. 9, 1991

[51] Int. Cl.[5] ..... B42D 15/00

[52] U.S. Cl. ..... 283/67; 283/114; 283/62; 283/92

[58] Field of Search ..... 283/67, 81, 89, 92, 283/114, 62

[56] References Cited

U.S. PATENT DOCUMENTS

| | | | |
|---|---|---|---|
| 2,300,787 | 11/1942 | Ingliss | 283/92 X |
| 2,330,718 | 9/1943 | Kallmann | 283/92 X |
| 3,042,426 | 7/1962 | Cohen | 283/62 |
| 3,599,229 | 8/1971 | Merrell | 346/75 |
| 4,451,530 | 5/1984 | Kaule et al. | 283/92 X |
| 4,526,403 | 7/1985 | Park | 283/62 |
| 4,691,940 | 9/1987 | Stenzel et al. | 283/92 X |
| 4,891,505 | 1/1990 | Jalon | 283/92 X |
| 4,957,312 | 9/1990 | Morello | 283/89 |
| 5,064,221 | 11/1991 | Miehe et al. | 283/67 |

*Primary Examiner*—Paul A. Bell

*Attorney, Agent, or Firm*—Tilton, Fallon, Lungmus & Chestnut

[57] ABSTRACT

A method for preventing counterfeiting of sales receipts which involves printing at different stages of both fixed and variable information on register rolls.

2 Claims, 1 Drawing Sheet

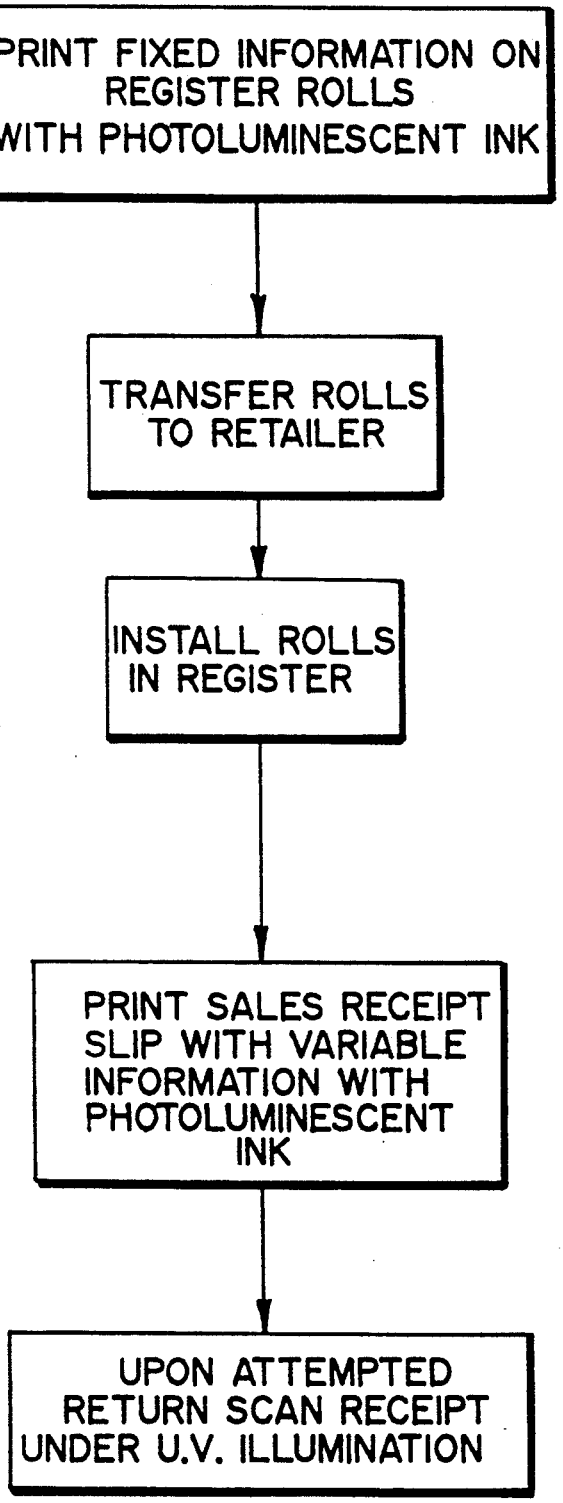
PRINT FIXED INFORMATION ON REGISTER ROLLS WITH PHOTOLUMINESCENT INK
TRANSFER ROLLS TO RETAILER
INSTALL ROLLS IN REGISTER
PRINT SALES RECEIPT SLIP WITH VARIABLE INFORMATION WITH PHOTOLUMINESCENT INK
UPON ATTEMPTED RETURN SCAN RECEIPT UNDER U.V. ILLUMINATION

METHOD FOR PREVENTING COUNTERFEITING OF SALES RECEIPTS

BACKGROUND AND SUMMARY OF INVENTION

This invention relates to a method for preventing counterfeiting of sales receipts and, more particularly, through the use of novel indicia for both fixed and variable information.

U.S. Pat. No. 4,957,312 is directed to a similar objective and featured a split ribbon to produce two color numbers and letters. It also suggested adding a component to the ribbon which was visible only under ultraviolet (UV) illumination. The use of such UV responsive components for security purposes is well known — see for example U.S. Pat. No. 3,599,229.

The instant invention improves upon the prior art teachings by first printing fixed information on register rolls with photoluminescent ink (UV responsive). These rolls are then transferred to the retailer who installs the same in registers. Thereafter the method involves printing the sales receipt slip with variable information with photoluminesent ink. Finally, upon attempted return of merchandise covered by the sales slip, it is scanned under UV illumination to determine the presence of both the fixed and variable information.

The fixed information referred to above is that common to all of the sales receipts and usually will include information on the seller whereas the variable information will change from receipt to receipt depending upon the merchandise purchased.

BRIEF DESCRIPTION OF DRAWING

The invention is explained in conjunction with the accompanying drawing which is schematic representation of the steps employed in the practice of the inventive method.

DETAILED DESCRIPTION

Referring now to the drawing, the first step is performed by the manufacturer of the register rolls who prints the same with ink containing a UV responsive component. This is advantageously done on a press which imprints the name and/or logo of the retailer or other patterned information at longitudinally spaced portions on the web and rewinds the web upon a core suitable for installation in the retailer's register or other computing machine.

The thus-completed rolls (bearing the "fixed"information) are then shipped to the manufacturer's customer, i.e., the retailer. This second step is represented by the second box in the drawing.

The retailer then installs the rolls in its register in conventional fashion — this third step being referred to in the third box of the drawing.

Upon a sale, the fourth step includes printing the "variable" information on a portion of the roll and normally would include the identification of the merchandise, the date of sale, the cost, etc. which is detached from the roll and given to the customer. This again is printed with ink carrying a UV-responsive component which advantageously may be the same as that employed for printing the fixed information.

In the drawing, the last box represents the step performed upon attempted return of the purchased merchandise which involves scanning the previously provided sales receipt under UV illumination. If there is not produced both the fixed and variable information, the attempted return of the merchandise is rejected because the sales receipt is a counterfeit.

The invention is further explained in conjunction with the following example:

EXAMPLE

The register roll referred to in the first box of the drawing is advantageously a convolutely wound web having a width of 2¾". A 1" diameter core is employed for the rewinding operation and incident to the printing of the web prior to rewinding, the web is printed with a conventional ink which has as an ingredient which is UV responsive. A suitable ingredient is Columbia Blue Dye available from Day-Glo Corporation.

In the fourth step of the drawing, reference is made to printing the sales slip with variable information and this is advantageously performed by a conventional ribbon cassette inserted into the register and which, in addition to a conventional ink formulation also includes a UV responsive component. In this example, the component again is the above referred to Columbia Blue Dye.

While in the foregoing specification a detailed description of an embodiment of the invention has been set down for the purpose of illustration, many variations in the details hereingiven may be made by those skilled in the art without departing from the spirit and scope of the invention.

We claim:

1. A method of preventing counterfeiting of sales receipts comprising the steps of:
   - providing at a manufacturing site a first ink having as a component one that is visible only under ultraviolet light,
   - providing at said manufacturing site an elongated web of receipt paper convolutely wound into a roll,
   - unwinding said roll and printing fixed information with said first ink in a plurality of longitudinally spaced places on said roll,
   - rewinding the printed paper into a roll,
   - transferring the printed roll to a point of sales site, providing at said sales site a ribbon having a second ink having as a component one that is visible only under ultraviolet light,
   - installing said ribbon in register means equipped with means adapted to print variable information through said ribbon on said roll,
   - creating different variable information for each of said longitudinally spaced places on said roll and introducing said variable information into said register means,
   - printing different variable information on each of said longitudinally spaced places on said roll,
   - detaching a portion of said roll carrying both said fixed and variable information relative to purchased merchandise and giving it as a sales receipt to the purchaser, and
   - upon attempted return of the merchandise subjecting the said sales receipt to ultraviolet light examination to determine the presence of both said fixed and variable information.

2. The method of claim 1 in which said steps include providing each of said first and second inks with the same component.

* * * * *